US007040744B2

(12) United States Patent
Shinada

(10) Patent No.: US 7,040,744 B2
(45) **Date of Patent: *May 9, 2006**

(54) INK CARTRIDGE AND INKJET PRINTER

(75) Inventor: Satoshi Shinada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/935,091

(22) Filed: Sep. 8, 2004

(65) Prior Publication Data

US 2005/0030340 A1 Feb. 10, 2005

Related U.S. Application Data

(63) Continuation of application No. 09/974,046, filed on Oct. 11, 2001, now Pat. No. 6,796,635.

(30) Foreign Application Priority Data

Oct. 11, 2000 (JP) ..... P2000-310779
Oct. 9, 2001 (JP) ..... P2001-310829

(51) Int. Cl.
*B41J 2/175* (2006.01)

(52) U.S. Cl. ..... 347/86

(58) Field of Classification Search ..... 347/19, 347/49, 50, 85, 86, 87
See application file for complete search history.

(56) References Cited

U.S. PATENT DOCUMENTS 4,961,088 A * 10/1990 Gilliland et al. ..... 399/25
5,148,194 A 9/1992 Asai et al.
5,788,388 A * 8/1998 Cowger et al. ..... 400/703
6,039,430 A 3/2000 Helterline et al.
6,097,405 A 8/2000 Lo et al.
6,123,421 A 9/2000 Bartolome et al.
6,227,638 B1 * 5/2001 Childers et al. ..... 347/7
6,227,643 B1 * 5/2001 Purcell et al. ..... 347/19
6,416,166 B1 7/2002 Robinson et al.
6,502,917 B1 * 1/2003 Shinada et al. ..... 347/19
6,505,926 B1 1/2003 Trafton et al.
6,508,547 B1 * 1/2003 King et al. ..... 347/86
6,796,635 B1 * 9/2004 Shinada ..... 347/49

FOREIGN PATENT DOCUMENTS

| | | |
|---|---|---|
| EP | 0 623 471 A2 | 11/1994 |
| EP | 0 816 098 A2 | 1/1998 |
| EP | 0 878 307 A2 | 11/1998 |
| EP | 0 997 297 A1 | 5/2000 |
| JP | 61-41553 | 2/1986 |
| JP | 4-185355 | 7/1992 |
| JP | 08-216429 | 8/1996 |
| JP | 2000-103087 | 4/2000 |

* cited by examiner

*Primary Examiner*—Anh T.N. Vo
(74) *Attorney, Agent, or Firm*—Sughrue Mion, PLLC

(57) ABSTRACT

A plurality of ink cartridges are detachably attached to a cartridge holder of an inkjet printer and are aligned in parallel. Each ink cartridge includes a projection or a recess formed at a side of the ink cartridge that faces the adjacent ink cartridge. A set of the projection and the matching recess of each pair of adjacent ink cartridges forms a matching set in which the projection engages with the recess to position the ink cartridges with respect to each other. Each matching set has a different shape. Thus, when the ink cartridges are attached to the cartridge holder, the ink cartridges are connected together as aligned in a predetermined order.

13 Claims, 9 Drawing Sheets

INK CARTRIDGE AND INKJET PRINTER

This is a continuation of application Ser. No. 09/974,046 filed Oct. 11, 2001, now U.S. Pat. No. 6,796,635; the disclosure of which is incorporated herein by reference.

BACKGROUND OF THE INVENTION

The present invention relates to ink cartridges and inkjet printers.

Generally, color inkjet printers use a plurality of color inks. These printers may include a plurality of separate color ink cartridges that are independently replaceable. This structure allows the ink cartridges to be consumed completely, thus reducing costs.

In an inkjet printer that uses the separate ink cartridges, a cartridge accommodating portion accommodates the ink cartridges. Each ink cartridge must be accurately located at a predetermined position of the accommodating portion. Further, since each ink cartridge corresponds to a different color, the cartridges must be aligned in the accommodating portion in a predetermined order.

Conventionally, a positioning member divides the cartridge accommodating portion into a plurality of chambers. The positioning member positions each ink cartridge in the corresponding chamber, thus installing the cartridge in the printer.

However, the positioning member complicates the structure of the cartridge accommodating portion. Further, the cartridge accommodating portion must have a clearance for receiving the positioning member, in addition to the cartridge chambers. This enlarges the cartridge accommodating portion.

In an inkjet printer described in Japanese Unexamined Patent Publication No. 4-185355, an accommodating recess is formed as the cartridge accommodating portion. Convex and concave portions are formed in the inner wall of the recess. Matching convex and concave portions are formed in the outer wall of each ink cartridge. That is, when each cartridge is received in the recess, the convex and concave portions of the cartridge engage with those of the inner wall of the recess. In this manner, the cartridge is positioned in the recess.

However, in this case, the convex and concave portions must be formed with a high accuracy such that each ink cartridge is positioned in the recess accurately and reliably. The forming of the convex and concave portions is thus complicated. Particularly, machining of the inner wall of the recess is complicated such that production efficiency decreases.

In an inkjet printer described in Japanese Unexamined Patent Publication No. 61-41553, a plurality of head units are attached to a reciprocating carrier. Each head unit accommodates an ink container and includes an engaging projection and an engaging recess through which the head unit is connected to the adjacent head unit.

In this printer, each head unit accommodates a different color ink, and the head units must be aligned in a predetermined order. However, since these head units are identical, it is highly likely that the head units are aligned in an inaccurate order.

BRIEF SUMMARY OF THE INVENTION

Accordingly, it is an objective of the present invention to provide an ink cartridge that is easily and accurately installed in a cartridge accommodating portion of an inkjet printer and has a simple structure to minimize the cartridge accommodating portion.

It is another objective of the present invention to provide an inkjet printer that includes the ink cartridge.

To achieve the foregoing and other objectives and in accordance with the purpose of the present invention, the invention provides an ink cartridge for an inkjet printer. The ink cartridge is one of ink cartridges that are detachably attached to a cartridge accommodating portion of the inkjet printer as aligned in parallel. Each ink cartridge has at least one engaging portion formed at a side of the ink cartridge that faces an adjacent ink cartridge. A set of the opposed engaging portions of each pair of adjacent ink cartridges forms a matching set in which the engaging portions engage with each other to position the adjacent ink cartridges with respect to each other. The matching sets are shaped and located such that a fitting structure between one pair of adjacent ink cartridges and a fitting structure between another pair of adjacent ink cartridges are different in form.

In another aspect of the present invention, each ink cartridge includes a contact that contacts one of connecting members formed in the cartridge accommodating portion when the ink cartridge is attached to the cartridge accommodating portion. Each contact is located offset from the middle of the associated ink cartridge in an aligning direction of the ink cartridges.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS (First Embodiment)

Figure 1:
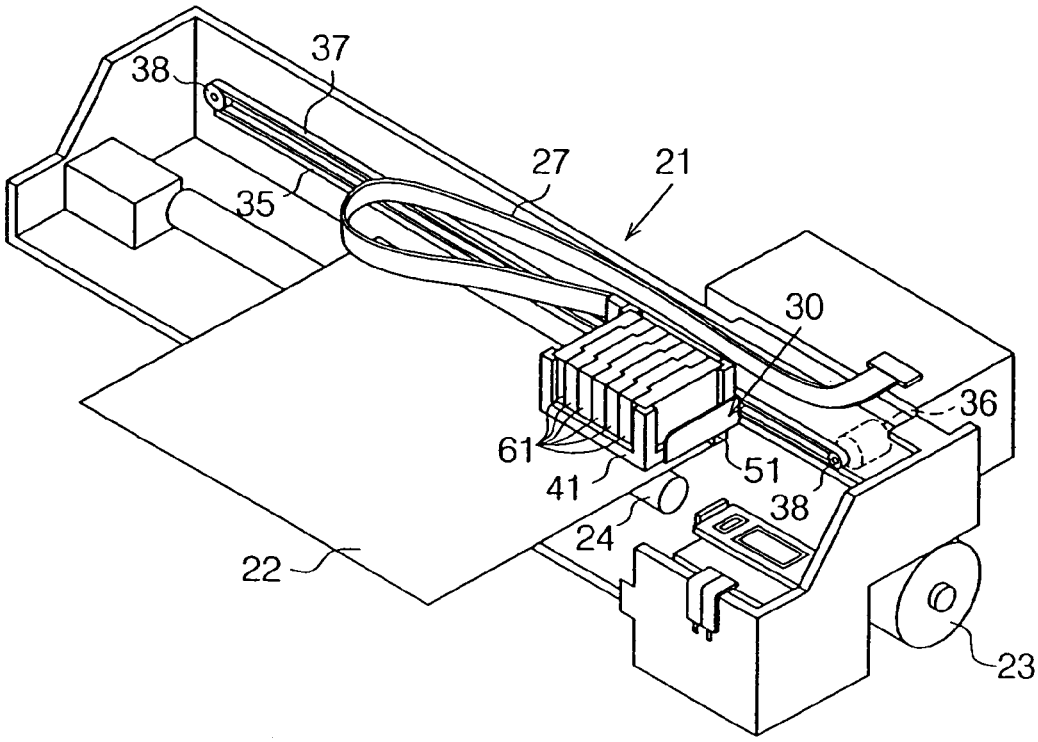
FIG. 1 is a schematic view showing an inkjet printer of a first embodiment according to the present invention.

A first embodiment of the present invention will now be described with reference to FIGS. 1 to 9. FIG. 1 shows the general structure of an inkjet printer 21. As shown in the drawing, the printer 21 includes a paper conveying mechanism that moves a sheet of paper 22 and a moving mechanism that moves a carriage 30, or an ink cartridge accommodating portion. The carriage 30 includes a printing mechanism that discharges ink on the sheet of paper 22 for printing.

The paper conveying mechanism includes a paper conveying motor 23, a paper conveying roller 24, and an additional roller (not shown). The paper conveying motor 23 functions as a drive source. The paper conveying roller 24 also functions as a platen roller. When the paper conveying motor 23 is activated, the paper conveying roller 24 and the additional roller are rotated to convey the sheet of paper 22.

The moving mechanism includes a guide member 35, a carriage motor 36, a pair of pulleys 38, and a timing belt 37. The guide member 35 is parallel with the axis of the paper conveying roller 24. The carriage motor 36 functions as a drive source. The timing belt 37 connects the pulleys 38 to each other. One pulley 38 is connected to the carriage motor 36. The carriage 30 is connected to the timing belt 37. When the carriage motor 36 is activated, the carriage 30 reciprocates along the guide member 35. More specifically, the carriage 30 moves in an axial direction of the guide member 35, or in a direction perpendicular to a conveying direction of the sheet of paper 22.

Figure 2:
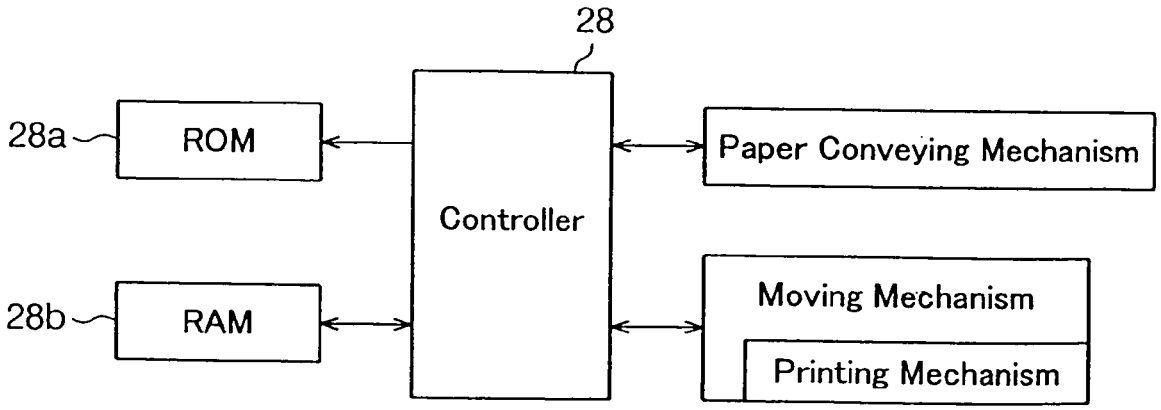
FIG. 2 is a block diagram showing the circuit configuration of the inkjet printer of FIG. 1.

As shown in FIG. 2, the inkjet printer 21 includes a controller 28, a read only memory (ROM) 28*a*, and a random access memory (RAM) 28*b*. The controller 28 is, for example, a central processing unit (CPU). The ROM 28*a* stores various programs and the RAM 28*b* stores working data. The controller 28 controls the paper conveying mechanism, the moving mechanism, and the printing mechanism, thus performing color printing on the sheet of paper 22.

Figure 3:
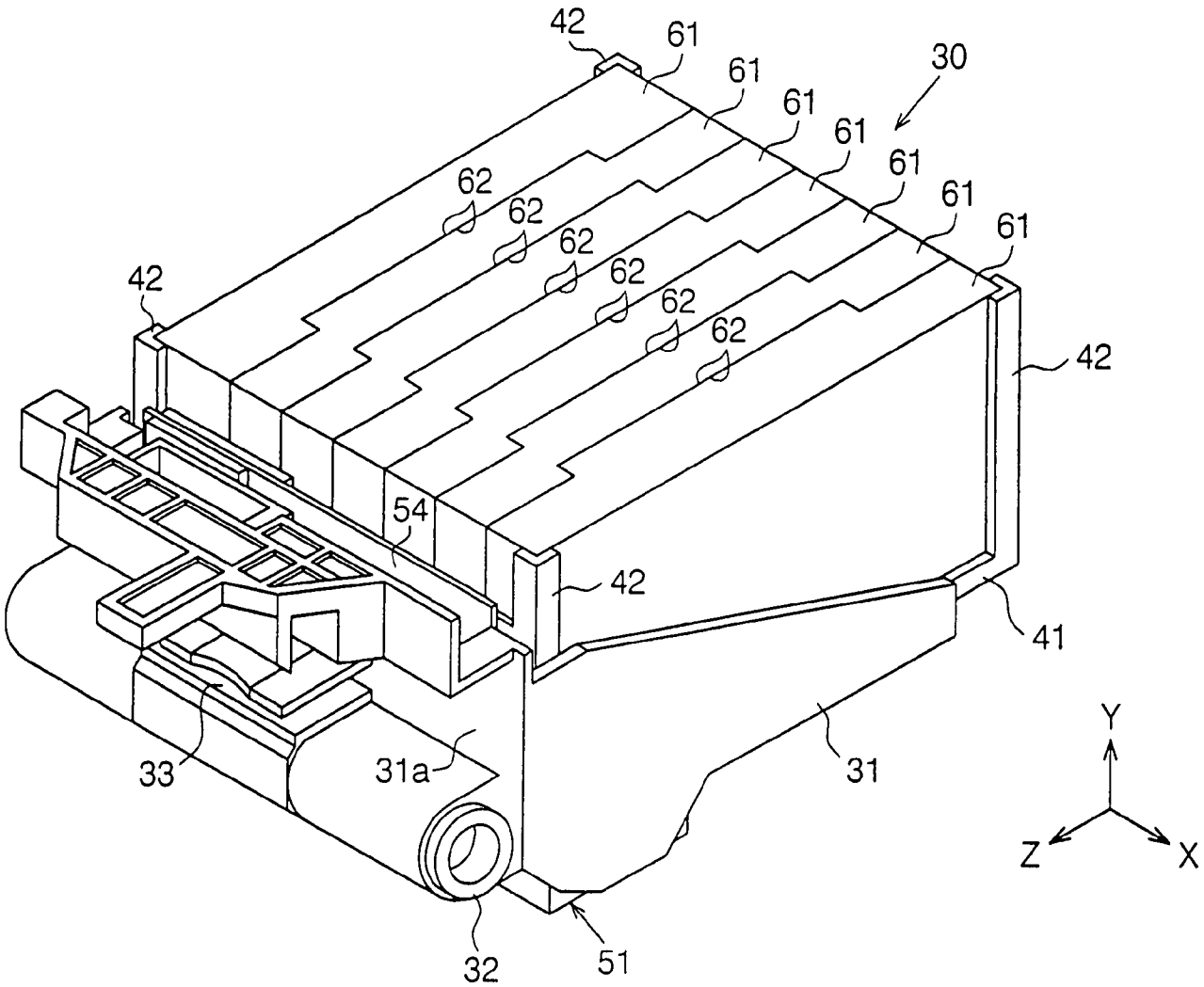
FIG. 3 is a perspective view showing a carriage of the printer of FIG. 1 in which ink cartridges are installed.
Figure 4:
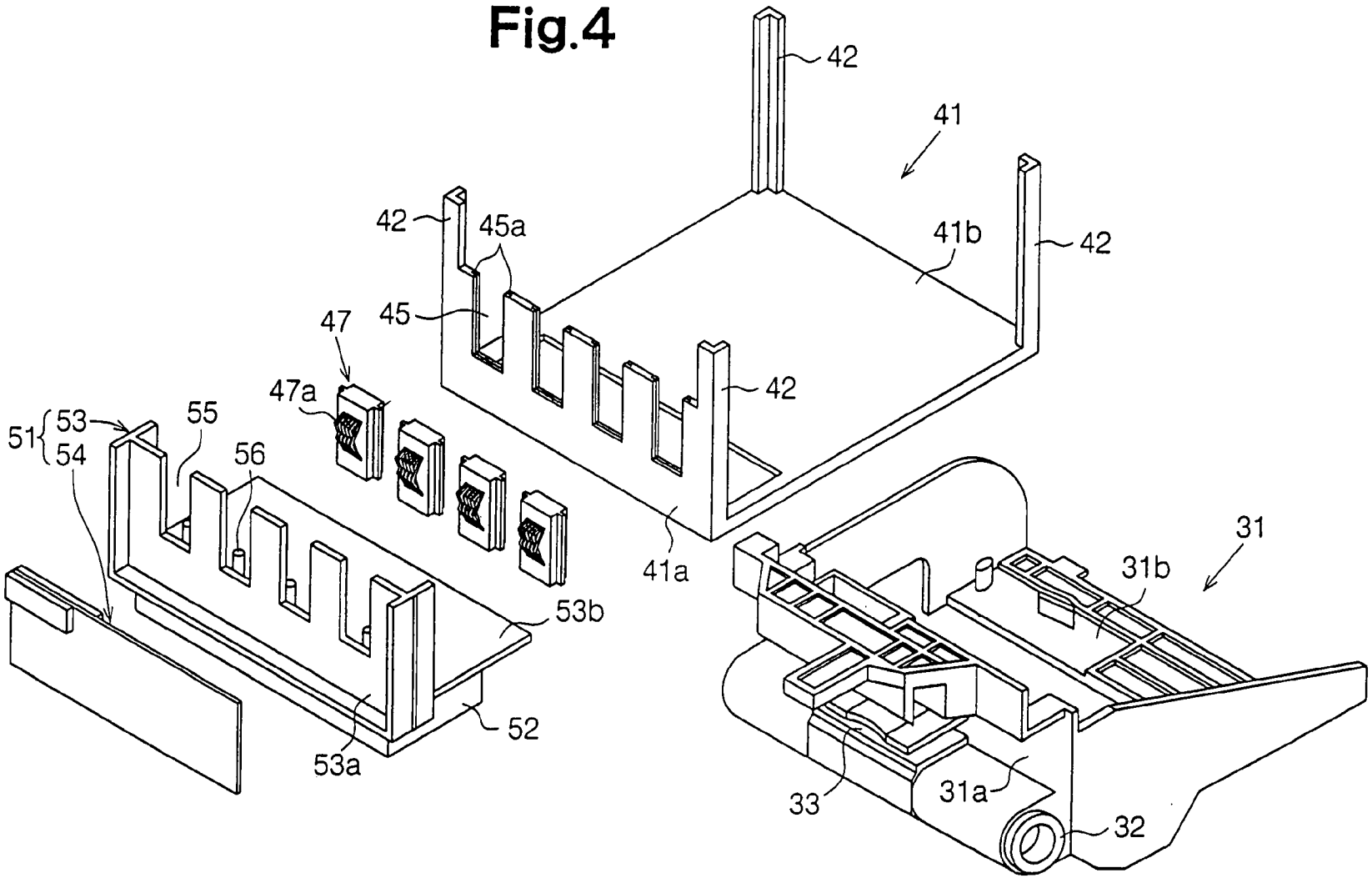
FIG. 4 is an exploded, perspective showing the carriage of FIG. 3.
Figure 5:
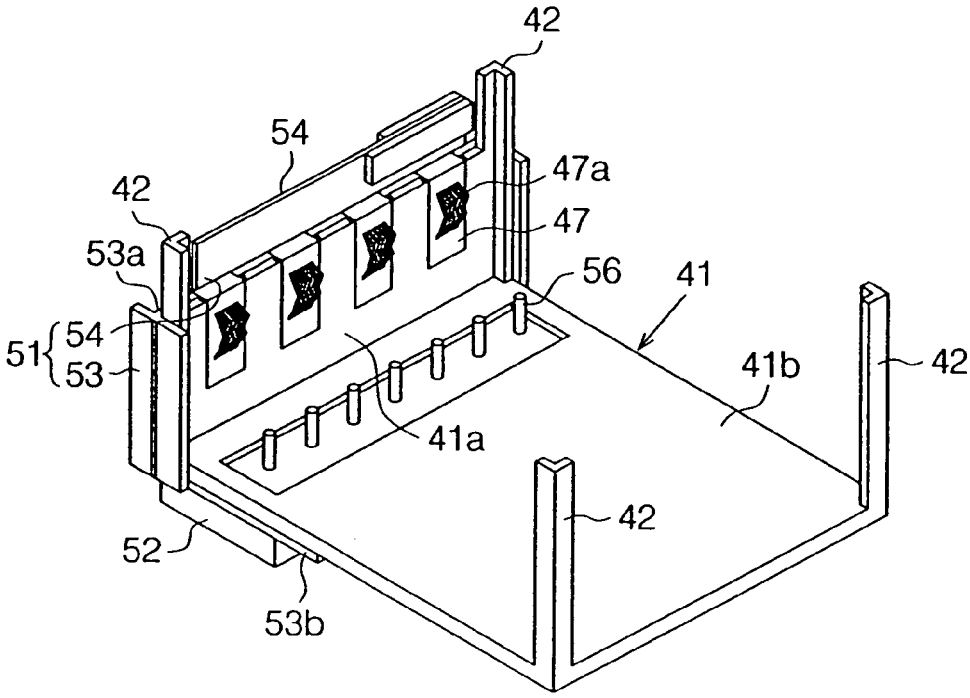
FIG. 5 is a perspective view showing a cartridge holder of FIG. 4.

As shown in FIGS. 3 to 5, the carriage 30 includes a carriage body 31 and a cartridge holder 41. The cartridge holder 41 is secured to the carriage body 31 through, for example, a screw (not shown).

The cartridge body 31 has a side wall 31*a* and a bottom 31*b*. A sleeve 32 and a connector 33 are located at the outer side of the side wall 31*a*. The sleeve 32 has a through hole through which the guide member 35 is passed. The connector 33 is connected to the timing belt 37.

The cartridge holder 41 includes a side wall 41*a* and a square bottom 41*b*. A vertical rib 42 projects from each corner of the bottom 41*b*. Each rib 42 has an L-shaped cross-section. The side wall 41*a* connects two ribs 42 to each other. A plurality of (in this embodiment, seven) ink cartridges 61 are placed on the bottom 41*b* as held by the ribs 42.

The side wall 41*a* has a plurality of (in this embodiment, four) windows 45. Each window 45 has an open, upper end. A connecting member 47 is fitted in each window 45. More specifically, a groove 45*a* is formed in the sides of each window 45, and each connecting member 47 includes a projection that is fitted in the groove 45*a*. A pair of contact groups 47*a* are formed at opposite sides of each connecting member 47. That is, one contact group 47*a* projects from the front side of each connecting member 47, and the other projects from the rear side of the connecting member 47. The contact groups 47*a* that project from the opposite sides of each connecting member 47 are connected to each other in the connecting member 47.

A printing head 51 functions as the aforementioned printing mechanism and is located in the cartridge holder 41. The printing head 51 includes a base 53, a head unit 52, and an IC board 54. The base 53 has a substantially T-shaped cross section. The head unit 52 discharges an ink drip. The IC board 54 controls the head unit 52. The base 53 includes a side wall 53*a* and a bottom 53*b*. The side wall 53*a* of the base 53 opposes the side wall 41*a* of the cartridge holder 41. The bottom 53*b* of the base 53 is secured to the lower side of the bottom 41*b* of the cartridge holder 41. A plurality of windows 55 are formed in the side wall 53*a* to oppose the corresponding windows 45 of the cartridge holder 41. Each connecting member 47 is thus fitted in the corresponding windows 45, 55.

The head unit 52 is secured to the bottom 53*b* of the base 53. The head unit 52 includes an inkjet mechanism 52*a* (see FIG. 8) and a plurality of (in this embodiment, seven) ink supply needles 56. The inkjet mechanism 52*a* discharges an ink drip. When the ink cartridges 61 are installed in the cartridge holder 41, each ink supply needle 56 supplies ink from the corresponding ink cartridge 61 to the inkjet mechanism 52*a*. That is, one ink supply needle 56 corresponds to one ink cartridge 61 that is installed in the cartridge holder 41. Each ink supply needle 56 extends from the bottom 53*b* of the base 53 and passes through the bottom 41*b* of the cartridge holder 41, thus projecting upward vertically.

The IC board 54 is attached to the side wall 53*a* of the base 53 and is connected to the contact group 47*a* that projects from the front side of each connecting member 47. Further, a flexible flat cable 27 (see FIG. 1) is connected to one end of the IC board 54. The flexible flat cable 27 connects the IC board 54 to the controller 28.

Each ink cartridge 61 is detachably attached to the cartridge holder 41. The ink cartridges 61 are substantially identical. The structure of each ink cartridge 61 will hereafter be described.

Figure 6:
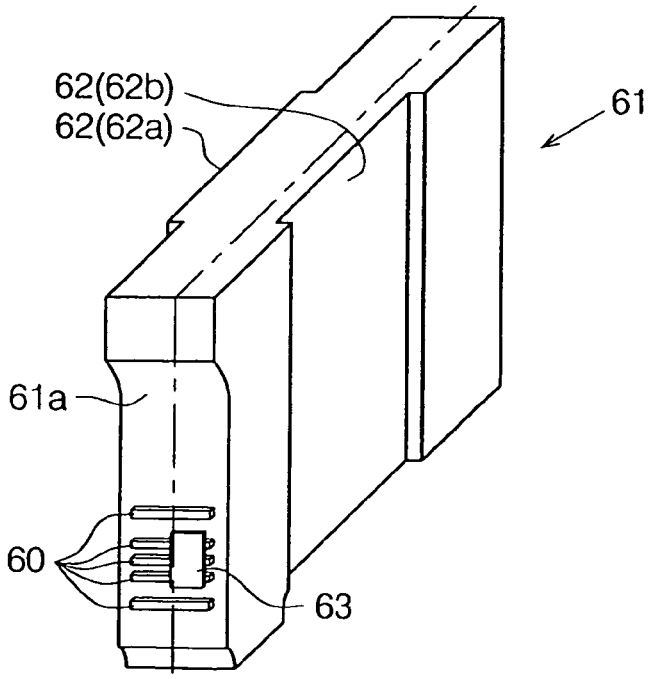
FIG. 6 is a perspective view showing an ink cartridge.
Figure 7:
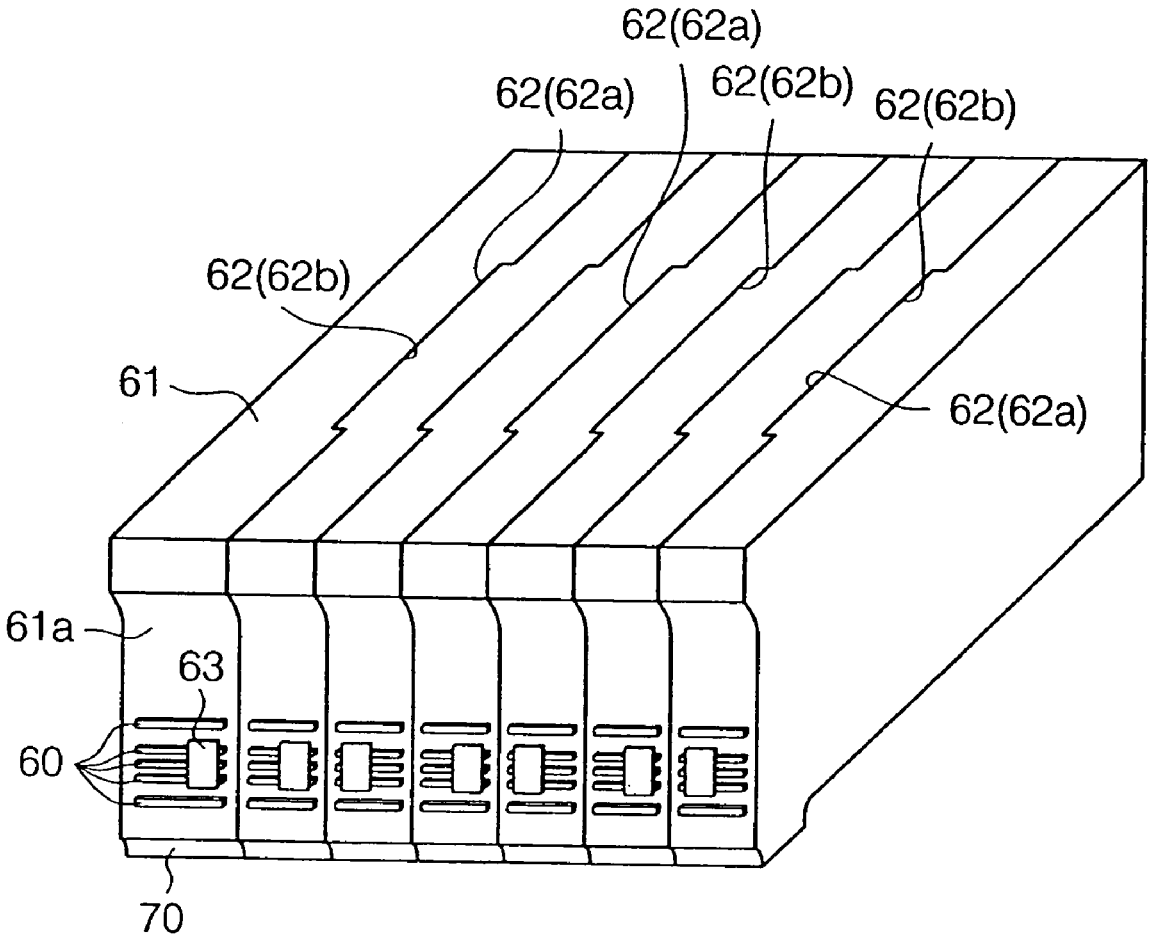
FIG. 7 is a perspective view showing combined ink cartridges.
Figure 8:
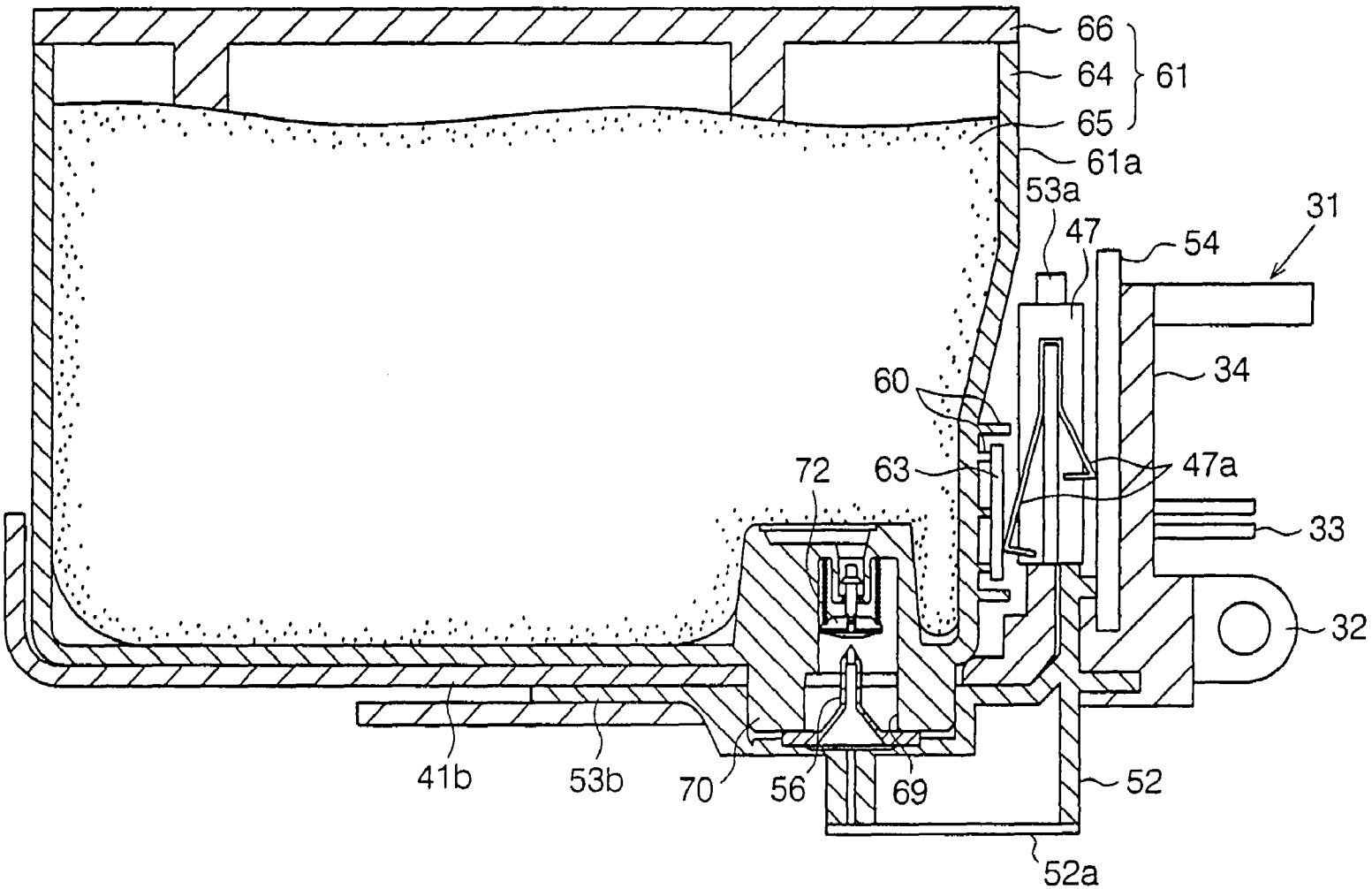
FIG. 8 is a cross-sectional view showing the ink cartridge and the carriage.

As shown in FIGS. 6 to 8, each ink cartridge 61 is shaped as a substantial rectangular parallelepiped. As shown in FIG. 7, the seven ink cartridges 61 are attached to the cartridge holder 41 such that the adjacent ink cartridges 61 closely contact each other. Each of the two ink cartridges 61 that correspond to opposite ends of the cartridge holder 41 has a single engaging portion 62 that is formed at one side of the ink cartridge 61. Each of these ink cartridges 61 engages with the adjacent ink cartridge 61 through the engaging portion 62. Each of the remaining five ink cartridges 61 has a pair of engaging portions 62 that are formed at opposite sides of the ink cartridge 61. Each of these five ink cartridges 61 engages with the adjacent ink cartridges 61 through the engaging portions 62.

The ink cartridge 61 that corresponds to one end of the cartridge holder 41 (located rightmost as viewed in FIG. 7) has a projection 62*a* that functions as the engaging portion 62. The ink cartridge 61 that corresponds to the other end of the cartridge holder 41 (located leftmost as viewed in FIG. 7) has a recess 62*b* that functions as the engaging portion 62. The remaining five ink cartridges 61 each include the projection 62*a* and the recess 62*b*.

Each projection 62*a* projects in a direction in which each ink cartridge 61 is moved for attaching the ink cartridge 61 to the cartridge holder 41 (as indicated by the axis Y of FIG. 3). The shape of the recesses 62*b* matches that of the projections 62*a*. When the ink cartridges 61 are attached to the cartridge holder 41, the adjacent ink cartridges 61 are connected to each other through engagement between each projection 62*a* and the matching recess 62*b*.

Each ink cartridge 61 has a front side 61*a* a lower portion of which forms a recess. A plurality of parallel ribs 60 are received in the recess. A circuit board 63 is attached to the corresponding ribs 60 of each ink cartridge 61. Each circuit board 63 is located near to one lateral side (the right side or the left side) of the ink cartridge 61.

Figure 9:
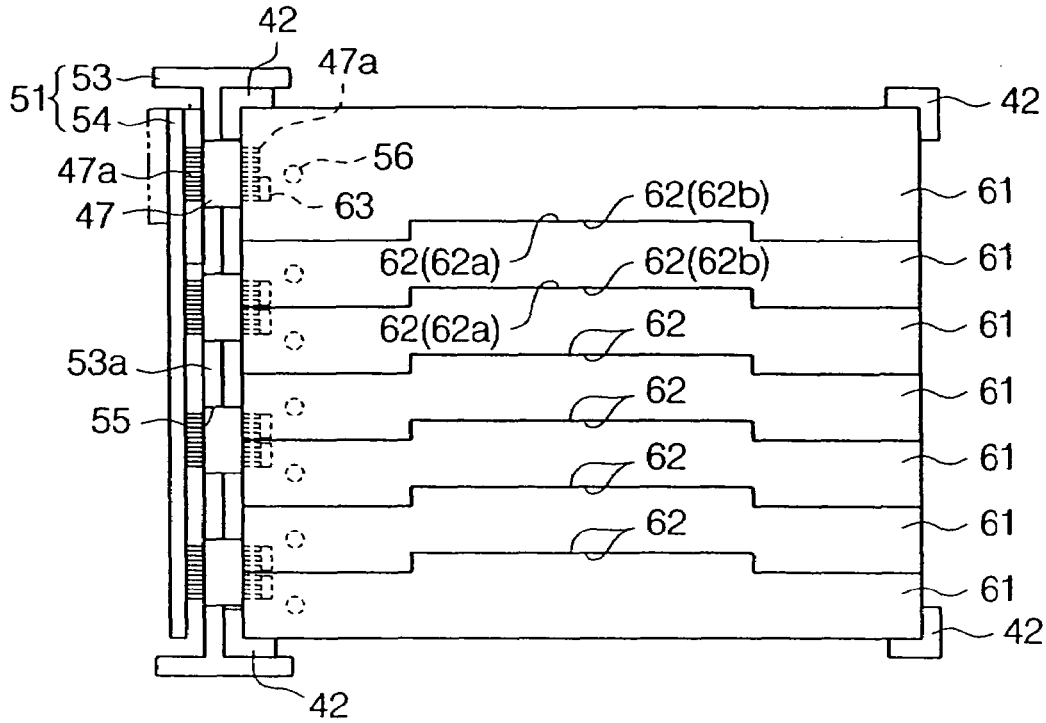
FIG. 9 is a plan view showing the ink cartridge and a cartridge holder.

Although not illustrated, each circuit board 63 includes a non-volatile memory (EEPROM). The EEPROM is rewritable and retains its content even when power supply is blocked. Each EEPROM stores data such as the ink content, the date of production, and the production number of the corresponding ink cartridge 61. A contact group (not shown) is formed on the front side of each circuit board 63, and the EEPROM is located on the rear side of the circuit board 63. An ink-resistant material encompasses each circuit board 63 except for the contact group. As shown in FIGS. 8 and 9, when each ink cartridge 61 is attached to the cartridge holder 41, the contact group of the circuit board 63 contacts the contact group 47*a* that projects from the rear side of the corresponding connecting member 47.

As shown in FIG. 8, each ink cartridge 61 includes a synthetic resin container 64, a porous body 65, and a lid 66. The container 64 is shaped as a substantial rectangular parallelepiped and has an upper opening. The porous body 65 is accommodated in the container 64. The lid 66 closes the opening of the container 64 and is joined with the container 64 through, for example, vibration depositing.

A projection 70 projects from the bottom of the container 64 of each ink cartridge 61 near the front side 61*a* of the ink cartridge 61. An ink supply port 69 is formed in each projection 70 for supplying ink from the associated container 64 to the inkjet printer 21. A valve mechanism 72 is located in each ink supply port 69. A rubber seal (not shown) is fitted in each ink supply port 69.

Each porous body 65 is formed of elastic material that has a number of continuous pores. The porous body 65 absorbs the ink in the associated container 64 through capillarity and retains the same. The ink is formed by dissolving or dispersing dye or pigment in a solvent. In this embodiment, black (BK), cyan (C), light cyan (LC), magenta (M), light magenta (LM), yellow (Y), and light yellow (LY) inks correspond to the different ink cartridges 61.

As described, the ink cartridges 61 are attached to the cartridge holder 41 such that the adjacent ink cartridges 61 are connected to each other through engagement between each projection 62*a* and the matching recess 62*b*, as shown in FIGS. 8 and 9. In this manner, each ink cartridge 61 is positioned with respect to the adjacent ink cartridge 61.

When attached to the cartridge holder 41, the ink cartridges 61 are positioned in an aligning direction of the ink cartridges 61 (along the axis X of FIG. 3). Further, each ink cartridge 61 is positioned in its forward or rearward direction, or a direction perpendicular to the axes X, Y of FIG. 3 (the axis Z of FIG. 3). Since each ink cartridge 61 is moved along the axis Y when attaching the ink cartridge 61 to the cartridge holder 41, as described, the ink cartridges 61 are accurately installed in the cartridge holder 41. Further, the ink supply ports 69 are precisely positioned with respect to the corresponding ink supply needles 56.

When each ink cartridge 61 is attached to the cartridge holder 41, the corresponding ink supply needle 56 enters the ink supply port 69 to open the valve mechanism 72. The ink in the ink cartridge 61 is thus supplied to the inkjet mechanism 52*a* through the ink supply port 69 and the ink supply needle 56. Further, the contact group of the circuit board 63 of each ink cartridge 61 contacts the contact group 47*a* that projects from the rear side of the corresponding connecting member 47. Accordingly, each circuit board 63 is electrically connected to the controller 28 through the corresponding connecting member 47, the IC board 54, and the flexible flat cable 27.

As described, each circuit board 63 is located near to one lateral side of the ink cartridge 61. Thus, as shown in FIG. 9, the circuit boards 63 of the two adjacent ink cartridges 61 are connected to one connecting member 47. However, the connecting member 47 closest to one end of the cartridge holder 41 corresponds to the single circuit board 63 of the ink cartridge 61 closest to the same end.

The first embodiment has the following advantages.

Each ink cartridge 61 has one or two engaging portions 62. The adjacent ink cartridges 61 are thus connected to each other through engagement between the engaging portions 62, or the projections 62*a* and the matching recesses 62*b*. Accordingly, each ink cartridge 61 is accurately positioned with respect to the adjacent ink cartridge 61. As a result, when attached to the cartridge holder 41, the ink cartridges 61 are located at correct positions in the cartridge holder 41 as positioned with respect each other.

Each ink cartridge 61 is positioned along a hypothetical plane perpendicular to the direction in which the ink cartridge 61 is moved for attaching the ink cartridge 61 to the cartridge holder 41 (as indicated by the axis Y of FIG. 3). The contact group of the circuit board 63 of each ink cartridge 61 thus reliably contacts the contact group 47*a* that projects from the rear side of the corresponding connecting member 47. Accordingly, data is reliably transferred between each circuit board 63 and the controller 28 such that the inkjet printer 21 operates accurately.

Further, the ink supply port 69 of each ink cartridge 61 is accurately positioned with respect to the corresponding ink supply needle 56. Thus, when replacing one ink cartridge 61, for example, the ink supply port 69 of the replacing ink cartridge 61 reliably receives the corresponding ink supply needle 56. This makes it easy to replace any ink cartridge 61.

Each engaging portion 62 of the ink cartridges 61 is the projection 62*a* or the recess 62*b* that have simple shapes. The structure for positioning the ink cartridges 61 thus becomes simple.

The projections 62*a* and the recesses 62*b* extend in a direction parallel with the direction in which each ink cartridge 61 is moved for attaching the ink cartridge 61 to the cartridge holder 41 (the axis Y of FIG. 3). Thus, when attaching each ink cartridge 61 to the cartridge holder 41, the projections 62*a* and the recesses 62*b* do not interfere. This makes it easy to attach or detach the ink cartridges 61 with respect to the cartridge holder 41.

It is unnecessary to provide a structure for positioning each ink cartridge 61 in the carriage 30. This simplifies the configuration of the carriage 30 and minimizes the same. Also, designing of the carriage 30 and that of the ink cartridges 61 become easy.

The circuit boards 63 of the adjacent two ink cartridges 61 are connected to the single connecting member 47. The number of the connecting members 47 is thus less than the number of the ink cartridges 61. This simplifies the configuration of the carriage 30.

(Second Embodiment)

Figure 10:
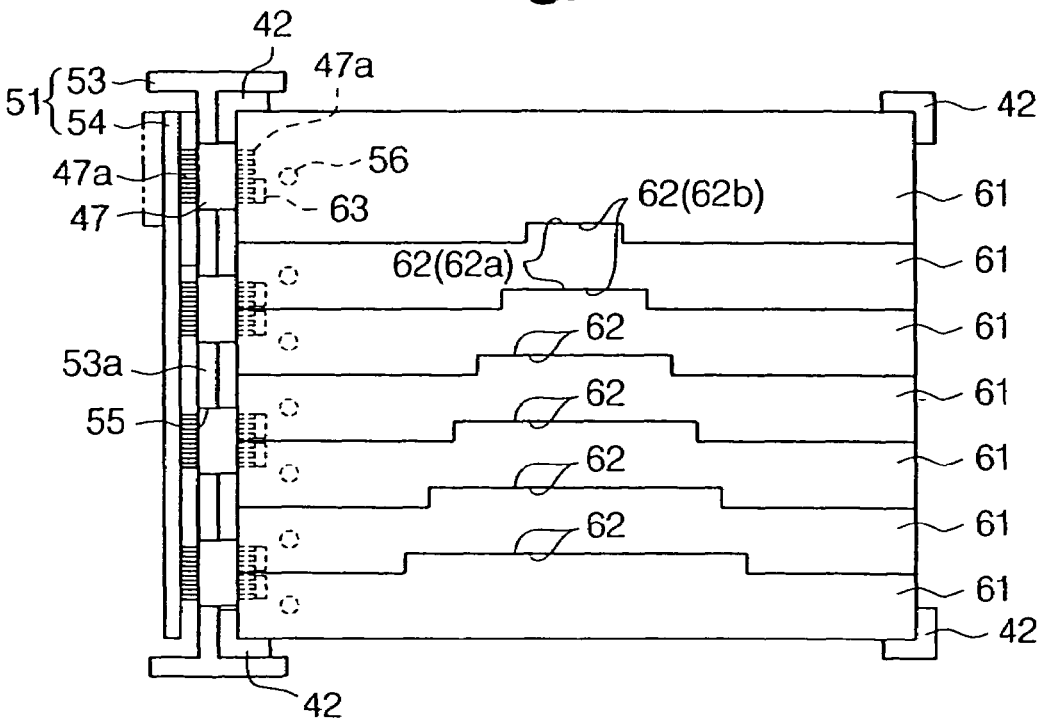
FIG. 10 is a plan view showing an ink cartridge and a cartridge holder of a second embodiment according to the present invention.

A second embodiment according to the present invention will hereafter be described with reference to FIG. 10. The description focuses on the difference between the second embodiment and the first embodiment illustrated in FIGS. 1 to 9. As shown in FIG. 10, in the second embodiment, each projection 62*a* of the ink cartridges 61 has a different dimension in a direction of the axis Z of FIG. 3, or a different width. Correspondingly, each recess 62*b* of the ink cartridges 61 has a different width. In other words, the width of the projection 62*a* and that of the matching recess 62*b* of one pair of adjacent ink cartridges 61 are different from the width of the projection 62*a* and that of the matching recess 62*b* of another pair of adjacent ink cartridges 41.

The projection 62*a* and the matching recess 62*b* of the adjacent ink cartridges 61 form a fitting structure for engaging these ink cartridges 61. The widths of the projections 62*a* and those of the matching recesses 62*b* become smaller gradually from the lowermost projection 62*a* and the matching recess 62*b* toward the uppermost, as viewed in FIG. 10. That is, the widths of the fitting structures become smaller gradually from the lowermost fitting structure toward the uppermost, as viewed in FIG. 10.

Accordingly, the second embodiment has the following advantages, in addition to those of the first embodiment of FIGS. 1 to 9.

When attaching the ink cartridges 61 to the cartridge holder 41, the ink cartridges 61 are connected together as aligned in a predetermined order simply by engaging each projection 62*a* and the matching recess 62*b*, which have equal widths. This makes it possible to attach the ink cartridges 61 to the cartridge holder 41 in the correct alignment order easily and accurately.

(Third Embodiment)

Figure 11:
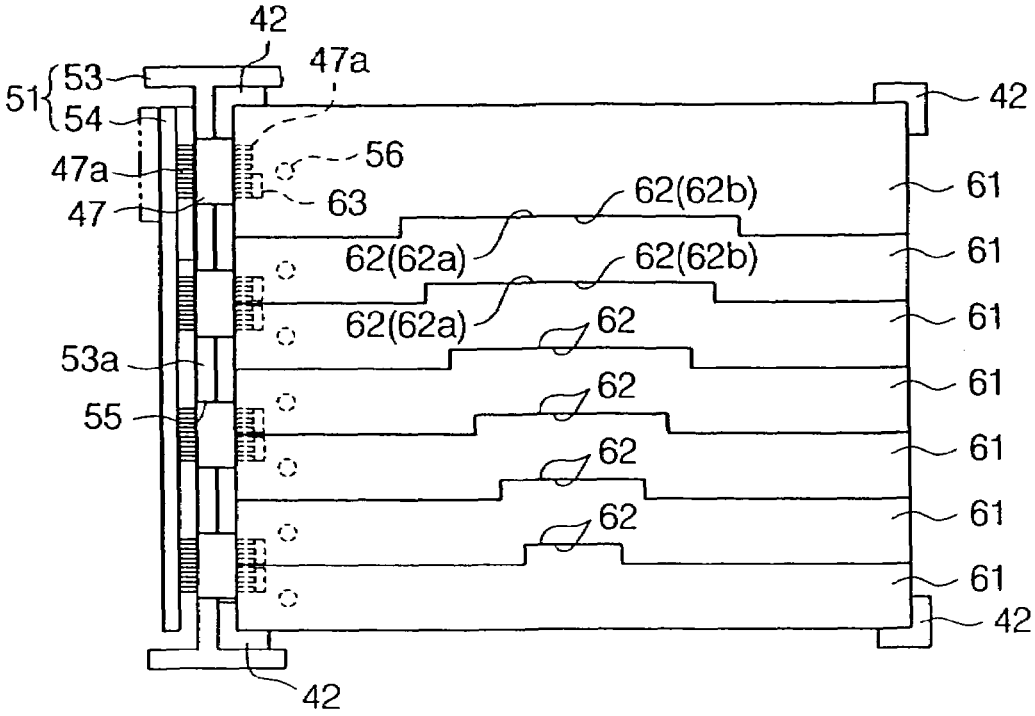
FIG. 11 is a plan view showing an ink cartridge and a cartridge holder of a third embodiment according to the present invention.

A third embodiment according to the present invention will hereafter be described with reference to FIG. 11. The description focuses on the difference between the third embodiment and the second embodiment illustrated in FIG. 10. As shown in FIG. 11, to the contrary of the second embodiment of FIG. 10, the widths of the projections 62*a* and those of the matching recesses 62*b* become greater gradually from the lowermost projection 62*a* and the matching recess 62*b* toward the uppermost, as viewed in FIG. 11.

Also, the ink cartridge 61 corresponding to an end of the cartridge holder 41 (the uppermost ink cartridge 61, as viewed in FIG. 11) is larger than the remaining ink cartridges 61. Also, the recess 62*b* of the relatively large ink cartridge 61 is larger than the recesses 62*b* of the remaining, relatively small ink cartridges 61. Further, in each of the ink cartridges 61 other than the two ink cartridges 61 corresponding to the opposite ends of the cartridge holder 41, the width of the projection 62*a* is larger than that of the recess 62*b*.

Accordingly, the third embodiment has the following advantages, in addition to those of the second embodiment of FIG. 10.

In the second embodiment, in each ink cartridge 61 that has the projection 62*a* and the recess 62*b*, the width of the projection 62*a* is smaller than that of the recess 62*b*. Thus, the dimension of this ink cartridge 61 in a direction of the axis X of FIG. 3, or the thickness of the ink cartridge 61, becomes relatively small at a position corresponding to a portion of the recess 62*b* that does not correspond to the projection 62*a*. In other words, the thickness of each ink cartridge 61 of the second embodiment is partially reduced. In contrast, in the third embodiment, each ink cartridge 61 has a substantially uniform thickness. Accordingly, any section of the porous body 65 is not excessively compressed, thus ink optimally flows in each ink cartridge 61. This reduces the amount of the ink that remains unconsumed in the ink cartridge 61.

(Fourth Embodiment)

Figure 12:
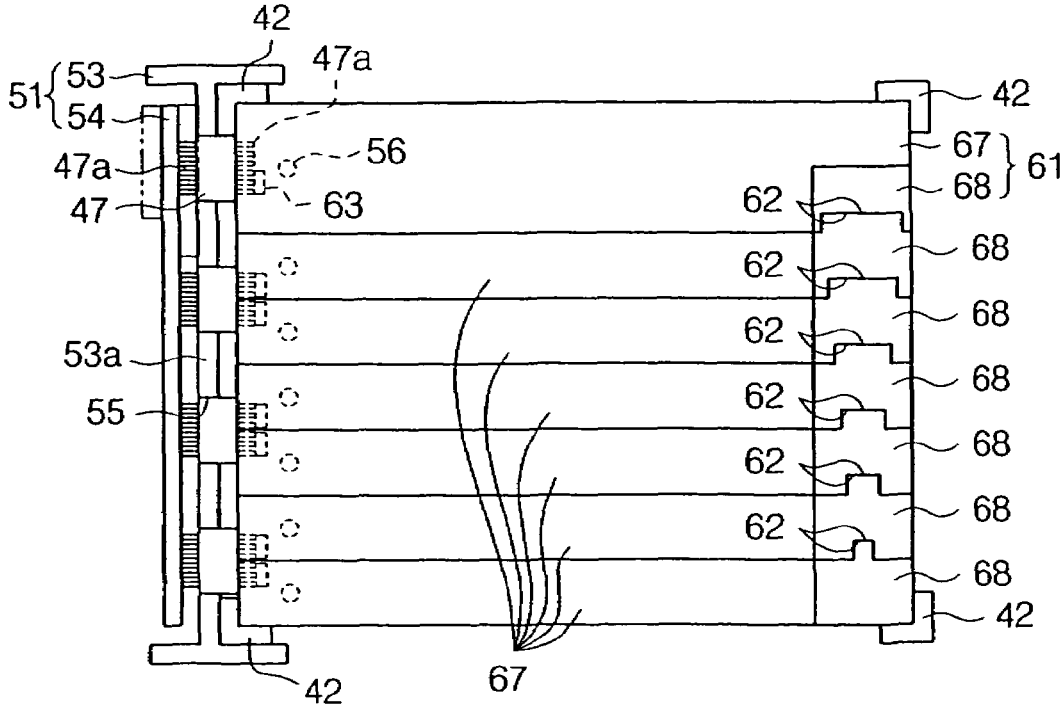
FIG. 12 is a plan view showing an ink cartridge and a cartridge holder of a fourth embodiment according to the present invention.

A fourth embodiment according to the present invention will hereafter be described with reference to FIG. 12. The description focuses on the difference between the fourth embodiment and the third embodiment illustrated in FIG. 11. As shown in FIG. 12, in the fourth embodiment, each ink cartridge 61 has a main body 67 and a sub body 68 connected to the main body 67. Each sub body 68 has the projection 62*a* and the recess 62*b*. Each sub body 68 is hollow and forms an ink chamber together with the associated main body 67. Alternatively, the sub bodies 68 may be solid.

The fourth embodiment has the following advantages, in addition to those of the third embodiment of FIG. 11.

Since the main bodies 67 are identical, the main bodies 67 are fabricated efficiently.

(Fifth Embodiment)

Figure 13:
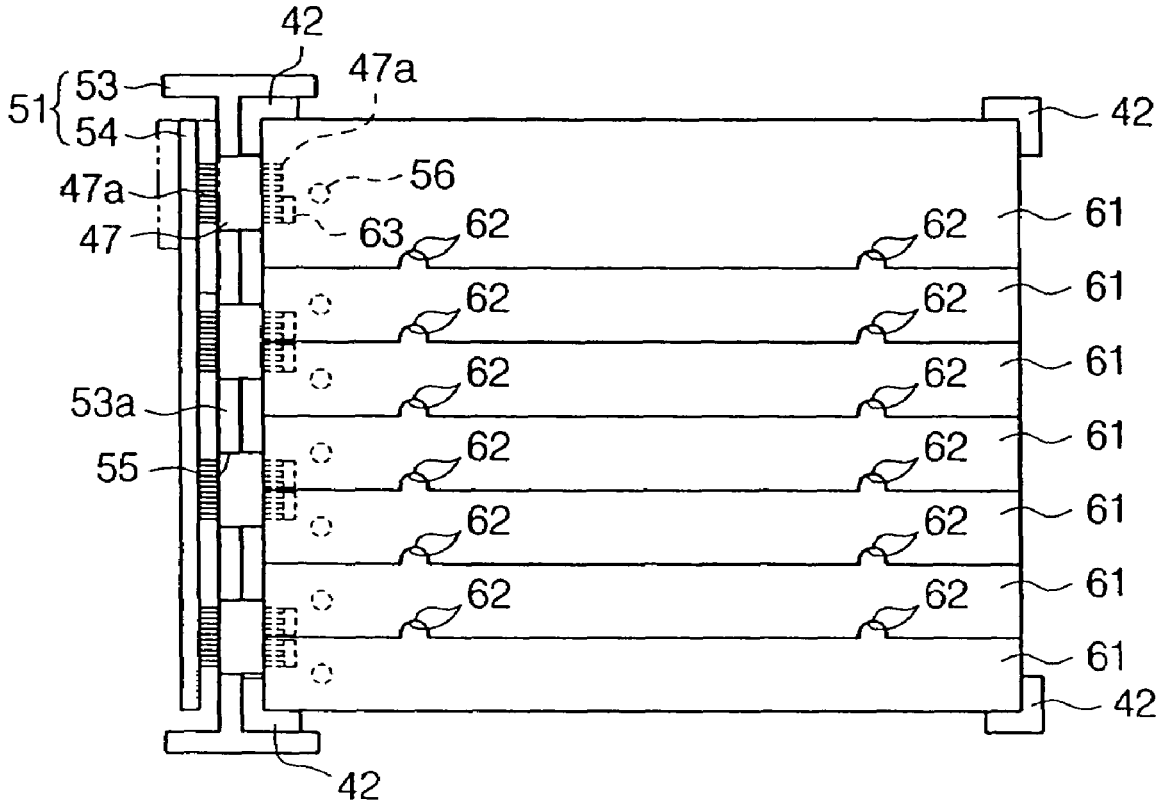
FIG. 13 is a plan view showing an ink cartridge and a cartridge holder of a fifth embodiment according to the present invention.

FIG. 13 shows a fifth embodiment in which a plurality of (two, in the drawing) engaging portions 62 (the projections 62*a* or the recesses 62*b*) are formed at each side of each ink cartridge 61. Each engaging portion 62 has a semicircular cross-sectional shape and extends in a direction parallel with the direction in which each ink cartridge 61 is moved for attaching the ink cartridge 61 to the cartridge holder 41.

The illustrated embodiments may be modified as follows.

The numbers, the shapes, and the locations of the engaging portions 62 (the projections 62*a* and the recesses 62*b*) are not restricted to those of the illustrated embodiments but may be modified as necessary. For example, each engaging portion 62 may have a conical or pillar-like shape.

The structures for aligning the ink cartridges 61 in a predetermined order are not restricted to those of the illustrated embodiments. The structures may have any form as long as, for example, one matching set of the projection(s) 62*a* and the recess(es) 62*b* and another matching set are different in at least number or shape or location. In other words, the fitting structure between the opposed contact sides of one pair of adjacent ink cartridges 61 and that of another pair must be different in form.

The ink cartridges 41 do not necessarily have to be installed in the carriage 30 but may be installed in the body of the inkjet printer 21. This structure also has the same advantages as those of the illustrated embodiments.

The connecting members 47 may be formed as a single connecting member. If this is the case, the cartridge holder 41 and the base 53 of the printing head 51 each have to include a single window for receiving the connecting member. This simplifies the structure of the carriage 30.

The present examples and embodiments are to be considered as illustrative and not restrictive and the invention is not to be limited to the details given herein, but may be modified within the scope and equivalence of the appended claims.

What is claimed is:

1. An ink cartridge, comprising:

an ink cartridge body having an interior defining an ink chamber therein, the ink cartridge body having, a bottom wall;

an ink supply port communicating with the ink chamber is provided on the bottom wall;

a front wall;

a first side wall and a second side wall intersecting the front wall; and a circuit board mounted on the front wall, the circuit board storing information about ink in said ink cartridge body, the circuit board facing outward, and the circuit board is located closer to the first side wall than the second side wall.

2. An ink cartridge according to claim 1, further comprising a protrusion extending outward and away from a plane of one of the first side wall and the second side wall of the ink cartridge.

3. An ink cartridge according to claim 1, wherein the circuit board is mounted in a recess formed on the front wall.

4. An ink cartridge according to claim 2, wherein the protrusion extends in a direction along which the ink cartridge moves during mounting on a printer carriage.

5. An ink cartridge according to claim 1, wherein the ink supply port extends in a direction along which the ink cartridge moves during mounting on a printer carriage.

6. An ink cartridge according to claim 1, wherein the ink cartridge defines a first ink cartridge and is positioned adjacent a second ink cartridge, said second ink cartridge comprising, a front wall;

a first side wall and a second side wall intersecting the front wall of the second ink cartridge; and a circuit board mounted on the front wall of the second ink cartridge, the circuit board of the second ink cartridge being located closer to the first side wall of the second ink cartridge than the second side wall of the second ink cartridge, wherein the first side wall of the first ink cartridge is disposed opposite the first side wall of the second ink cartridge.

7. An ink cartridge according to claim 1, wherein the ink cartridge further comprises a back wall distal to the front wall, said back wall being closer to the ink supply port than the front wall.

8. An ink cartridge for an inkjet printer, wherein the ink cartridge is one of a plurality of ink cartridges that are detachably attachable in successive arrangement to a cartridge accommodating portion of the inkjet printer, the inkjet printer having at least one electrically conductive contact member, said ink cartridge comprising:

an electrical contact positioned to contact said electrically conductive contact member which is formed in the cartridge accommodating portion when said ink cartridge is attached to the cartridge accommodating portion, said electrical contact being located on an outside surface of said ink cartridge and positioned offset from the middle of said ink cartridge in an aligning direction of the ink cartridge, said aligning direction extending parallel to a direction in which the plurality of ink cartridges would be successively arranged, said outside surface facing away from substantially all other surfaces of said ink cartridge, said outside surface of said ink cartridge extending substantially parallel to an insertion direction in which said ink cartridge is insertable into said ink cartridge accommodating portion.

9. The ink cartridge according to claim 8, wherein the electrical contact of said one of said plurality of ink cartridges and an electrical contact of another one of said plurality of ink cartridges are positioned to contact said contact member when both are inserted in said cartridge accommodation portion.

10. An ink cartridge according to claim 8, wherein the ink cartridge defines a first ink cartridge and is positioned adjacent a second ink cartridge of the plurality of ink cartridges;

the first ink cartridge having a first side wall and a second side wall, the electrical contact of the first ink cartridge being positioned closer to the first side wall than the second side wall; and said second ink cartridge comprises an electrical contact on an outside surface of the second ink cartridge, the second ink cartridge having a first side wall and a second side wall, the electrical contact of the second ink cartridge being positioned closer to the first side wall of the second ink cartridge than the second side wall of the second ink cartridge, wherein the first side wall of the first ink cartridge is disposed opposite the first side wall of the second ink cartridge.

11. An ink cartridge according to claim 8, wherein the ink cartridge further comprises an ink supply port and a back wall distal to the front wall, the back wall being closer to the ink supply port than the front wall.

12. A plurality of ink cartridges for an inkjet printer, the plurality of ink cartridges are detachably attachable in successive arrangement to a cartridge accommodating portion of the inkjet printer, the plurality of ink cartridges comprising:

a first ink cartridge including, an ink cartridge body having an interior defining an ink chamber therein, the ink cartridge body having, a bottom wall;

an ink supply port communicating with the ink chamber provided on the bottom wall;

a front wall;

a first side wall and a second side wall intersecting the front wall; and a circuit board mounted on the front wall, the circuit board storing information about ink in said ink cartridge body, the circuit board facing outward and being located closer to the first side wall than the second side wall;

a second ink cartridge adjacent the first ink cartridge, the second ink cartridge including, an ink cartridge body having an interior defining an ink chamber therein, the ink cartridge body of the second ink cartridge having, a bottom wall;

an ink supply port communicating with the ink chamber of the second ink cartridge provided on the bottom wall of the second ink cartridge;

a front wall;

a first side wall and a second side wall intersecting the front wall of the second ink cartridge; and a circuit board mounted on the front wall of the second ink cartridge, the circuit board of the second ink cartridge storing information about ink in said second ink cartridge body, the circuit board of the second ink cartridge facing outward and being located closer to the first side wall of the second ink cartridge than the second side wall of the second ink cartridge, and wherein the first side wall of the first ink cartridge is disposed opposite the first side wall of the second ink cartridge.

13. An ink cartridge according to claim 12, wherein the first and second ink cartridges each comprise a back wall distal to the front wall, said back walls respectively being closer to the ink supply ports than the front walls.

* * * * *